US005159731A

United States Patent [19]

Dereadt

[11] Patent Number: 5,159,731

[45] Date of Patent: Nov. 3, 1992

[54] CLOTHESPIN

[76] Inventor: Tod H. Dereadt, 41857 Kentvale, Mt. Clemens, Mich. 48044

[21] Appl. No.: 772,247

[22] Filed: Oct. 7, 1991

[51] Int. Cl.[5] ..... A44B 21/00

[52] U.S. Cl. ..... 24/552; 24/562; 24/564

[58] Field of Search ..... 24/552, 536, 564, 497, 24/512, 513, 489, 498, 517, 509, 562, 553, 554

[56] References Cited

U.S. PATENT DOCUMENTS

| | | | |
|---|---|---|---|
| D. 309,809 | 8/1990 | Davidson . | |
| 807,151 | 12/1905 | Calder et al. | 24/552 |
| 2,471,141 | 5/1949 | Castelli . | |
| 2,562,751 | 7/1951 | Tegarty | 24/562 |
| 2,585,089 | 2/1952 | Caldwell et al. | 24/562 |
| 2,676,377 | 4/1954 | Garcia . | |
| 3,058,186 | 10/1962 | Fanning, Jr. . | |
| 3,482,293 | 12/1969 | Takahashi et al. | 24/564 |
| 3,923,213 | 12/1975 | George et al. | 24/562 |
| 4,079,765 | 3/1978 | Hatayan . | |
| 4,765,335 | 8/1988 | Schmidt et al. | 24/552 |
| 4,835,824 | 6/1989 | Durham et al. | 24/562 |
| 5,042,191 | 8/1991 | Fett | 24/552 |

FOREIGN PATENT DOCUMENTS

| | | | |
|---|---|---|---|
| 0008914 | 8/1933 | Australia | 24/554 |

*Primary Examiner*—Victor N. Sakran
*Attorney, Agent, or Firm*—Alex Rhodes

[57] ABSTRACT

An adjustable unitary clothespin which is molded from a resilient material and ready to use in the "as molded" condition. The clothespin is comprised of an arcuate upper portion and a pair of downward extending leg portions. The leg portions are movable from positions of adjacent non-interlocking relationship to positions of abutting interlocking relationship. When the legs are interlocked, surfaces of the legs are resiliently urged together by the upper arcuate portion to clamp an article of clothing between the leg portions. Extending outwardly from opposite sides of the upper arcuate portions is a pair of handles for displacing the interlocking leg portions to receive the article of clothing.

4 Claims, 2 Drawing Sheets

CLOTHESPIN

BACKGROUND OF THE INVENTION

This invention relates to clothespins and more particularly to unitary clothespins for suspending articles of clothing. One deficiency in the prior art is that unitary clothespins lack adequate clamping force to retain articles of clothing. Consequently, clothing often separate from clothespins. Another deficiency is that no positive means is provided for retaining clothespins on a clothesline. Consequently, clothespins often fall from clothes-lines. Still Yet another deficiency is that unitary clothespins are incapable of accommodating a wide variety of clothes.

SUMMARY OF THE INVENTION

The present invention is an adjustable unitary clothespin which is molded from a resilient material. One benefit of the invention is that in the "as molded" condition it is ready to be used. Another benefit of the invention is that a positive means is provided for retaining the clothespin to a clothesline. Another benefit is that a substantial clamping force is provided for retaining an article of clothing.

The clothespin is comprised of an arcuate upper portion and a pair of downward extending leg portions. The leg portions are movable from positions of adjacent non-interlocking relationship to positions of abutting interlocking relationship. When the legs are interlocked, surfaces of the legs are resiliently urged together by the upper arcuate portion to clamp an article of clothing between the leg portions. Extending outwardly from opposite sides of the upper arcuate portions is a pair of handles for displacing the interlocking leg portions to receive the article of clothing.

The foregoing benefits and features, together with additional benefits and features, will become more apparent from the ensuing description and drawings which describe the invention in detail. A preferred embodiment and the manner of using the invention are disclosed and the subject matter in which exclusive property rights are claimed is set forth in each of the numbered claims at the conclusion of the detailed description.

DETAILED DESCRIPTION OF THE PREFERRED EMBODIMENT

Figure 3:
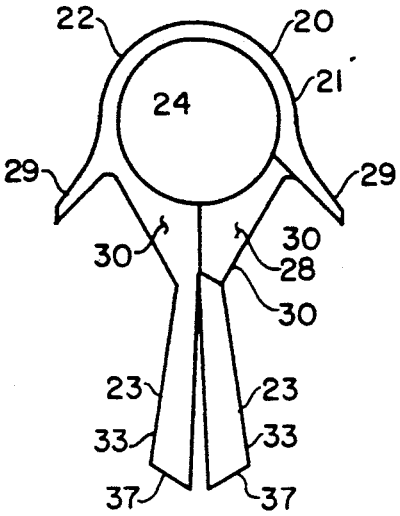
FIG. 3 is a rear view of the clothespin shown in FIG. 1.

Referring now to the drawings wherein like numerals designate like and corresponding parts, in FIGS. 1 through 7, inclusive, a clothespin, generally designated by the numeral 20, is shown for purposes of illustrating my invention. The clothespin 20 is a unitary clothespin 20 which is molded from a resilient plastic material.

Figure 2:
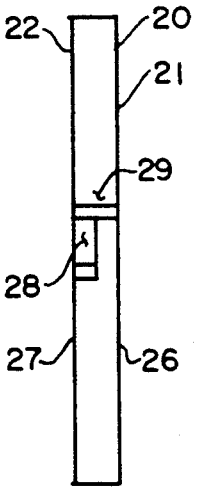
FIG. 2 is a right side view of the clothespin shown in FIG. 1.
Figure 1:
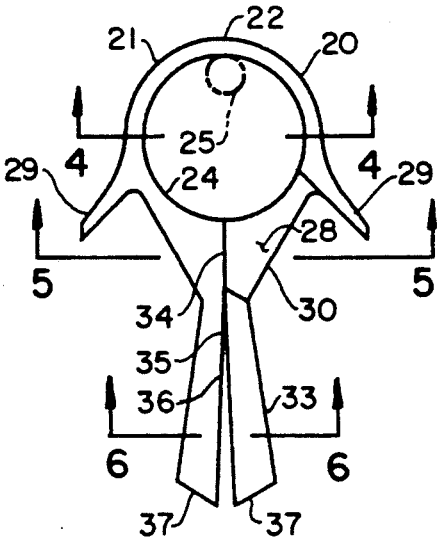
FIG. 1 is a front view of a clothespin in an "as molded" condition which embodies the present invention.
Figure 6:
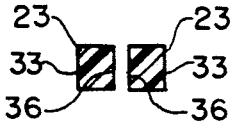
FIG. 6 is a cross-sectional view taken on the line 6—6 of FIG. 2.
Figure 5:
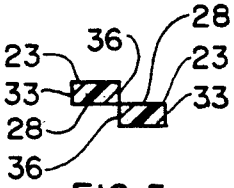
FIG. 5 is a cross-sectional view taken on the line 5—5 of FIG. 1.
Figure 4:
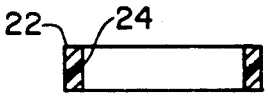
FIG. 4 is a cross-sectional view taken on the line 4—4 of FIG. 1.

The "as molded" configuration 21 of the clothespin 20 is depicted in FIGS. 1 through 3. It is comprised of an arcuate upper portion 22 and a pair of downward extending legs 23 which depend from terminal end portions of the upper arcuate portion 22. The overall appearance of my clothespin 20 resembles a key. In the center of the arcuate upper portion 22 there is an aperture 24 for positively retaining the clothespin 20 on a clothesline 25 as shown in phantom. The clothespin 20 has parallel front 26 and rear 27 faces. In the front and rear faces are notches 28 which, as will be seen, retain the legs 23 in an operative condition. Extending outwardly from the arcuate upper portion 22 are a pair of handles 29 which are used to separate the legs 23 in the operative condition.

The upper portions 30 of the outer sides 31 of the legs 23 in the "as molded" condition 21 taper downwardly and inwardly from the arcuate upper portion 22 to lower portions 33 which taper downwardly and outwardly. The upper portions 34 of the inner sides 35 of the legs 23 in the "as molded" condition 21 are in vertical abutting relationship and the lower portions 36 taper downwardly and outwardly to short lower faces 37 which connect the outer 31 and inner 35 side faces. In the "as molded" condition 21, the legs 23 are in adjacent non-interlocking relationship.

Figure 9:
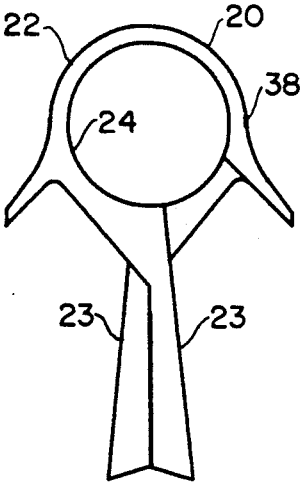
FIG. 9 is a rear view of the clothespin in the "operative" condition.
Figure 8:
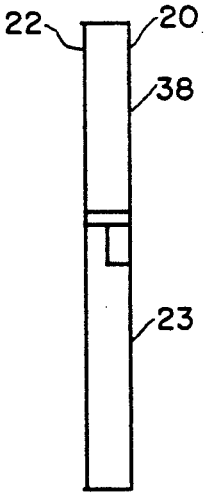
FIG. 8 is a right side view of the clothespin in the "operative" condition.
Figure 7:
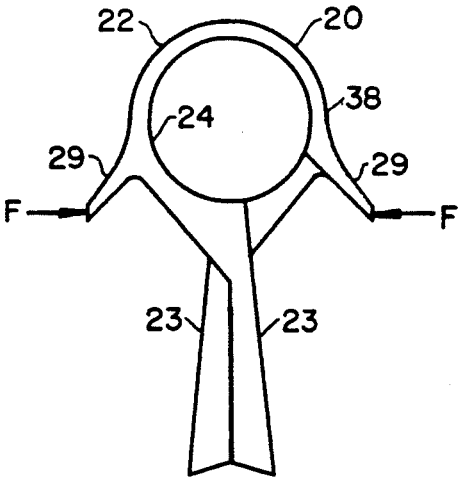
FIG. 7 is a front view of the clothespin in an "operative" condition.
Figure 12:
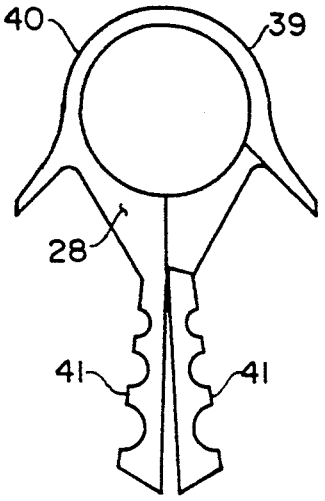
FIG. 12 is a rear view of the clothespin shown in FIG. 10.
Figure 11:
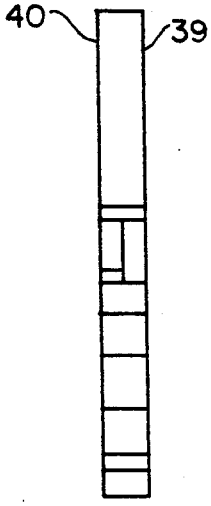
FIG. 11 is a right side view of the clothespin shown in FIG. 10.
Figure 10:
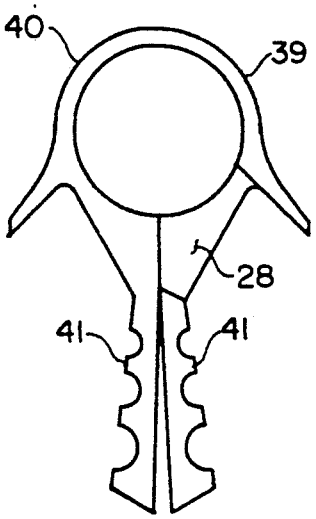
FIG. 10 is a front view of an alternate embodiment of the clothespin in an "as molded" condition.

In FIGS. 7 through 9, the clothespin 20 is shown in its operative condition 38. In the operative condition 38, the legs 23 are in crossed interlocking relationship. It will be observed that the lower portions 32 of the outer sides 31 of the legs 23 in the "as molded" condition 21 of FIGS. 1 through 3, abut each other in the operative condition and are inner sides. The operative condition 38 of the clothespin is achieved by deflecting and crossing the legs 23 to engage the notches 28 of the legs 23. Prior to crossing and interlocking the legs 23, the clothespin 20 is installed on the clothesline 25, as shown in FIG. 1.

One benefit of the invention is that when the legs 23 are interlocked, the deflection of the arcuate upper portion 22 provides a substantial clamping force for retaining an article of clothing. The legs 23 are separated in the operative condition by applying a force to the handles in the direction of the arrows F—F of FIG. 7.

Figure 13:
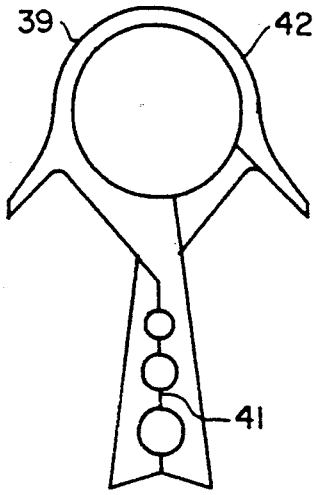
FIG. 13 is a front view of the alternate embodiment in its "operative" condition.

With reference to FIGS. 10 through 14, an alternate embodiment 39 is shown "as molded" 40 wherein the outer sides 41 of the legs 23 are serrated to increase the retention of the clothing by the clothespin 39. The embodiment 39 is useful when heavy clothing is retained by the clothespin 39. In FIG. 13, the operative condition 42 of the second embodiment 39 is illustrated. It will be observed that in the operative condition 42, the serrated sides 42 abut each other and have become the inner sides of the legs 23 In FIG. 14, the serrated sides 41 are shown separated to receive an article of clothing.

Figure 15:
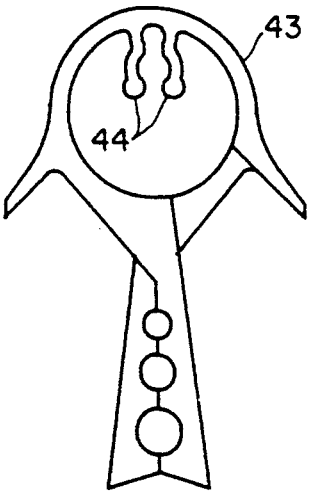
FIG. 15 is a front view of a second alternate embodiment in its "operative" condition.
Figure 14:
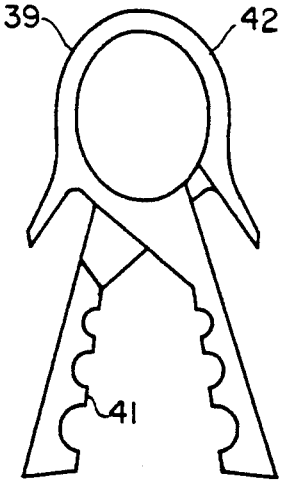
FIG. 14 is a front view of the alternate embodiment with downward extending legs separated to receive an article of clothing.

In FIG. 15, a second alternate embodiment 43 is shown having a pair of downward depending resilient fingers 44 for positively retaining the clothesline on the center of the clothespin 43.

From the foregoing it will be appreciated that my invention provides a unitary clothespin which is simple and ready to use in an "as molded" condition having a means for positively retaining the clothespin to a clothesline and substantial clamping force for retaining a variety of clothes.

Although I have illustrated and disclosed only several embodiments of my invention, it is not my intention to limit my invention to these embodiments. It will be understood that other embodiments can be developed by mere changes in shape and materials without departing from the spirit thereof.

I claim:

1. A clothespin comprising: a molded unitary body, said body having a resilient arcuate upper portion, said resilient upper portion having a pair of lower terminal portions for attaching an integral pair of downward extending leg portions; a downward extending leg portion depending from each of said pair of terminal portions, said leg portions being symmetrical and movable from positions of "as molded" non-interlocking relationship to positions of "operative" crossed interlocking relationship, said leg portions having serrated outer surfaces which are in non-abutting relationship in said "as molded" condition and in abutting relationship in said positions of "operative" crossed interlocking relationship for clamping an article of clothing between said leg portions and said leg portions having inner surfaces which are in non-abutting relationship in said "as molded" condition and in non-abutting relationship in said positions of "operative" crossed interlocking relationship; a means for interlocking said leg portions when said leg portions are in said positions of "operative" crossed interlocking relationship; a pair of handles extending downwardly and outwardly angled from the sides of said arcuate resilient upper portion for separating said leg portions in said operative condition to receive said article of clothing; and a resilient means for retaining a clothesline to said clothespin.

2. The clothespin recited in claim 1 wherein said means for interlocking said leg portions comprises a recessed portion in each of said leg portions, said recessed portions being configured to interlock said leg portions in said crossed interlocking relationship.

3. The clothespin recited in claim 1 further comprising a second pair of leg portions, each of said second leg portions extending outwardly and downwardly from an opposite side of said upper portion.

4. A clothespin comprising: a unitary body molded from a resilient material, said body having an arcuate upper portion; a pair of downward depending leg portions, said leg portions being in non-interlocking relationship in the "as molded" condition of said body and movable from said non-interlocking relationship to a crossed interlocking relationship in the "operative" condition of said body, said leg portions having outer surfaces in said "as molded" condition which are in non-abutting relationship and become inner abutting surfaces in said operative condition for clamping an article of clothing to said clothespin; and a pair of handles extending downwardly and outwardly angled from the sides of said arcuate portion for separating said leg portions in said operative condition to receive said article of clothing.

* * * * *